US005972426A

United States Patent [19]

Kutsuzawa et al.

[11] Patent Number: 5,972,426

[45] Date of Patent: Oct. 26, 1999

[54] METHOD OF COATING SUBSTRATE WITH COATING NOZZLE

[75] Inventors: Junji Kutsuzawa; Hiroyoshi Sago; Futoshi Shimai; Hidenori Miyamoto, all of Kanagawa, Japan

[73] Assignee: Tokyo Ohka Kogyo Co., Ltd., Kanagawa, Japan

[21] Appl. No.: 09/005,495

[22] Filed: Jan. 12, 1998

Related U.S. Application Data

[62] Division of application No. 08/627,694, Mar. 29, 1996, Pat. No. 5,769,946.

[30] Foreign Application Priority Data

Mar. 29, 1995 [JP] Japan ..... 7-94196

[51] Int. Cl.[6] ..... B05D 3/12

[52] U.S. Cl. ..... 427/240; 427/385.5; 427/421; 437/231

[58] Field of Search ..... 427/240, 385.5, 427/421; 437/231

[56] References Cited

U.S. PATENT DOCUMENTS

| | | | |
|---|---|---|---|
| 4,398,493 | 8/1983 | Gillett et al. | 118/303 |
| 4,550,681 | 11/1985 | Zimmer et al. | 118/410 |
| 4,622,239 | 11/1986 | Schoenthaler et al. | 118/410 |
| 4,938,994 | 7/1990 | Choinski | 427/96 |

FOREIGN PATENT DOCUMENTS

| | | |
|---|---|---|
| 63-156320 | 6/1988 | Japan . |
| 4332116 | 11/1992 | Japan . |
| 6151296 | 5/1994 | Japan . |

*Primary Examiner*—Janyce Bell

*Attorney, Agent, or Firm*—Carrier, Blackman & Associates, P.C.; Joseph P. Carrier; William D. Blackman

[57] ABSTRACT

A coating nozzle includes an elongate nozzle body having a coating solution reservoir defined longitudinally therein for being supplied with a coating solution from an external coating solution supply. The elongate nozzle body also has a coating solution holder defined therein and opening away from the coating solution reservoir, for holding a coating solution against falling off as droplets under surface tension of the coating solution. A plurality of passages are defined in the elongate nozzle body and held in communication with the coating solution reservoir and the coating solution holder, for supplying the coating solution from the coating solution reservoir to the coating solution holder.

16 Claims, 4 Drawing Sheets

METHOD OF COATING SUBSTRATE WITH COATING NOZZLE

This is a divisional of application Ser. No. 08/627,694 filed Mar. 29, 1996, now U.S. Pat. No. 5,769,946.

BACKGROUND OF THE INVENTION

1. Field of the Invention

The present invention relates to a coating nozzle for applying a coating solution such as a photoresist or the like to a surface of a workpiece such as a glass substrate, a semiconductor wafer, or the like, a method of coating a workpiece with such a coating nozzle, and a coating device incorporating such a coating nozzle.

2. Description of the Relevant Art

Photoresists are coated on glass substrates for use in liquid crystal display panels to produce color filters thereon, and various coating solutions are coated on the substrate surfaces of semiconductor wafers. For uniformly coating such a solution on a substrate, it has been customary to drop the solution onto the central area of the substrate and rotate the substrate with a spinner at a high speed to spread the dropped solution uniformly over the entire surface of the substrate under centrifugal forces.

When the substrate is rotated with the spinner, however, since the dropped solution needs to be spread uniformly to the outer peripheral edge of the substrate, a large amount of solution tends to be scattered off the substrate, resulting in a large consumption of the solution before the substrate surface is fully coated with the solution.

Coating devices having a slit nozzle for minimizing the amount of a coating solution to be applied to a substrate have been proposed in the art. For example, such coating devices are disclosed in Japanese laid-open patent publications Nos. 63-156320, 4-332116, and 6-151296.

The coating devices shown in Japanese laid-open patent publications Nos. 63-156320 and 4-332116 have a slit nozzle positioned over a substrate to be coated. While the substrate is slowly rotating below the slit nozzle, a coating solution is dropped from the slit nozzle onto the upper surface of the substrate, so that the coating solution is coated to a certain uniform thickness on the upper surface of the substrate. Thereafter, the substrate is rotated at a high speed to render the coated thickness of the solution more highly uniform.

According to Japanese laid-open patent publication No. 6-151296, a coating solution is discharged under pressure from a slit nozzle while the slit nozzle is moving closely along a surface of a substrate. The coating solution discharged from the slit nozzle is pressed against the substrate surface by the tip of the slit nozzle, forming a flat solution layer on the substrate surface.

As revealed in the above publications, the amount of the coating solution used can be minimized when the substrate is rotated at a high speed after the coating solution has been applied to the substantially entire surface of the substrate through the slit nozzle.

The slit nozzles disclosed in the above publications comprise either a number of nozzle orifices arranged in line or a single thin elongate nozzle orifice for ejecting the coating solution in a slit pattern having a certain width. The disclosed slit nozzles tend to allow the coating solution to fall off as droplets and suffer localized discharge pressure variations, failing to coat the coating solution as a uniform layer.

SUMMARY OF THE INVENTION

It is therefore an object of the present invention to provide a coating nozzle for applying a coating solution uniformly to a surface of a workpiece.

Another object of the present invention to provide a method of applying a coating solution uniformly to a surface of a workpiece with such a coating nozzle.

Still another object of the present invention to provide a coating device for applying a coating solution uniformly to a surface of a workpiece with such a coating nozzle.

According to the present invention, there is provided a coating nozzle comprising an elongate nozzle body having a coating solution reservoir defined longitudinally therein for being supplied with a coating solution from an external coating solution supply, a coating solution holder defined in said elongate nozzle body and opening away from said coating solution reservoir, for holding a coating solution against falling off as droplets under surface tension of the coating solution, and a plurality of passages defined in said elongate nozzle body and held in communication with said coating solution reservoir and said coating solution holder, for supplying the coating solution from said coating solution reservoir to said coating solution holder. The term "longitudinally" as used herein indicates the longest dimension of the nozzle, which extends in a direction perpendicular to the direction of movement of the nozzle over the surface of the workpiece.

According to the present invention, there is also provided a coating nozzle comprising an elongate nozzle body having a pair of parallel independent coating solution reservoirs defined longitudinally therein for being supplied with a coating solution from an external coating solution supply, a coating solution holder defined in said elongate nozzle body and opening away from said coating solution reservoirs, for holding a coating solution against falling off as droplets under surface tension of the coating solution, and a pair of sets of passages defined in said elongate nozzle body and held in communication with said coating solution reservoirs, respectively, and said coating solution holder, for supplying the coating solution from said coating solution reservoirs to said coating solution holder.

According to the present invention, there is provided a method of coating a substrate with a coating solution using a coating nozzle including an elongate nozzle body having a coating solution reservoir defined longitudinally therein for being supplied with a coating solution from an external coating solution supply, a coating solution holder defined in the elongate nozzle body and opening away from the coating solution reservoir, for holding a coating solution against falling off as droplets under surface tension of the coating solution, and a plurality of passages defined in the elongate nozzle body and held in communication with the coating solution reservoir and the coating solution holder, for supplying the coating solution from the coating solution reservoir to the coating solution holder, said method comprising the steps of applying the coating solution supplied from said coating solution reservoir through said passages and said coating solution holder, to a substantially entire surface of the substrate, and thereafter rotating the substrate to spread the applied coating solution uniformly over the surface of the substrate under centrifugal forces.

According to the present invention, there is also provided a method of coating a substrate with a coating solution with a coating nozzle including an elongate nozzle body having a pair of parallel independent coating solution reservoirs defined longitudinally therein for being supplied with a coating solution from an external coating solution supply, a coating solution holder defined in the elongate nozzle body and opening away from the coating solution reservoirs, for holding a coating solution against falling off as droplets under surface tension of the coating solution, and a pair of sets of passages defined in the elongate nozzle body and held in communication with the coating solution reservoirs, respectively, and the coating solution holder, for supplying the coating solution from the coating solution reservoirs to the coating solution holder, the method comprising the steps of applying the coating solution supplied from said coating solution reservoirs through said passages and said coating solution holder, to a substantially entire surface of the substrate, and thereafter rotating the substrate to spread the applied coating solution uniformly over the surface of the substrate under centrifugal forces.

According to the present invention, there is also provided a coating device for coating a substrate with a coating solution, comprising a coating nozzle including an elongate nozzle body having a coating solution reservoir defined longitudinally therein for being supplied with a coating solution from an external coating solution supply, a coating solution holder defined in said elongate nozzle body and opening away from said coating solution reservoir, for holding a coating solution against falling off as droplets under surface tension of the coating solution, and a plurality of passages defined in said elongate nozzle body and held in communication with said coating solution reservoir and said coating solution holder, for supplying the coating solution from said coating solution reservoir to said coating solution holder, and a rotatable cup disposed below said coating nozzle, for supporting and rotating a substrate which is coated with a coating solution supplied from said coating solution reservoir through said passages and said coating solution holder.

According to the present invention, there is further provided a coating device for coating a substrate with a coating solution, comprising an elongate nozzle body having a pair of parallel independent coating solution reservoirs defined longitudinally therein for being supplied with a coating solution from an external coating solution supply, a coating solution holder defined in said elongate nozzle body and opening away from said coating solution reservoirs, for holding a coating solution against falling off as droplets under surface tension of the coating solution, and a pair of sets of passages defined in said elongate nozzle body and held in communication with said coating solution reservoirs, respectively, and said coating solution holder, for supplying the coating solution from said coating solution reservoirs to said coating solution holder, and a rotatable cup disposed below said coating nozzle, for supporting and rotating a substrate which is coated with a coating solution supplied from said coating solution reservoirs through said passages and said coating solution holder.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
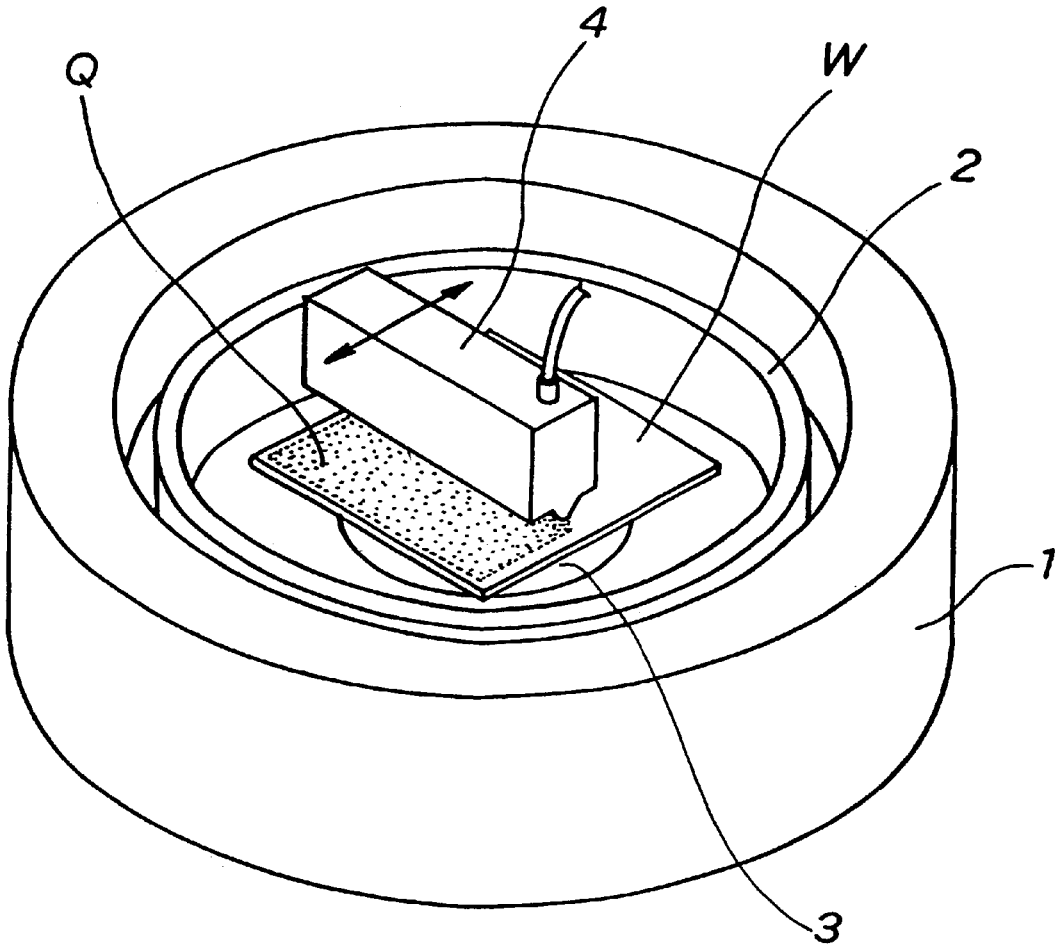
FIG. 1 is a perspective view of a coating device incorporating a coating nozzle according to the present invention.

FIG. 1 shows a coating device incorporating a coating nozzle according to the present invention. As shown in FIG. 1, the coating device has a circular outer cup 1, a circular inner cup 2 disposed in the outer cup 1 and rotatable by a spinner (not shown), a chuck 3 disposed in the inner cup 2 for attracting and holding a glass substrate W, and a coating nozzle 4 positioned above the inner cup 2. The glass substrate W may be of a rectangular shape or a circular shape though it is illustrated as being of a rectangular shape.

The coating nozzle 4 is mounted on an arm (not shown) which is actuatable to move the coating nozzle 4 vertically toward and away from the glass substrate W supported by the chuck 3 and horizontally parallel to an upper surface of the supported glass substrate W in the direction of the arrow. While the coating nozzle 4 is being moved, it applies a coating solution Q substantially uniformly to the substantially entire upper surface of the glass substrate W.

After the coating nozzle 4 has applied the coating solution Q to the glass substrate W, the inner cup 2 is rotated thereby to rotate the glass substrate W for spreading the coating solution Q uniformly over the substantially entire upper surface of the glass substrate W under centrifugal forces.

While the inner cup 2 is being rotated, it is preferable to cover the upper opening of the inner cup 2 with a lid (not shown) to increase the concentration of a solution atmosphere in the inner cup 2 for thereby preventing the coating solution Q from being unduly dried in the process of spreading the coating solution Q over the glass substrate W.

Figure 2:
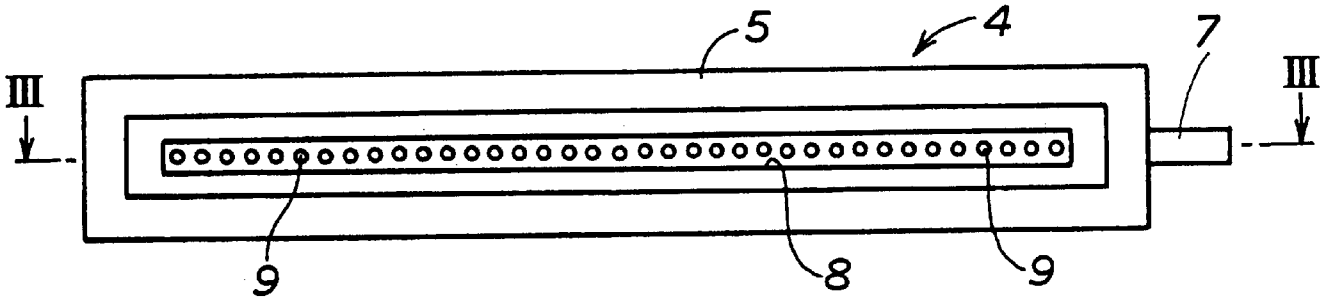
FIG. 2 is a bottom view of the coating nozzle according to the present invention.
Figure 3:
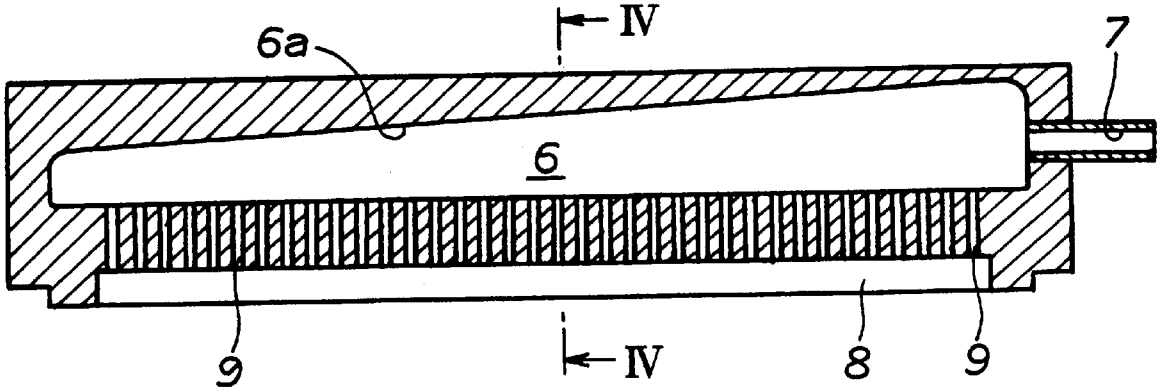
FIG. 3 is a cross-sectional view taken along line III—III of FIG. 2.

The coating nozzle 4 will be described in detail below with reference to FIGS. 2 through 3. The coating nozzle 4 has an elongate nozzle body 5 with a coating solution reservoir 6 defined in and extending longitudinally of the elongate nozzle body 5. The nozzle body 5 has a supply port 7 disposed on one end thereof and connected to an end of the coating solution reservoir 6, for introducing a coating solution from an external coating solution supply through the supply port 7 into the coating solution reservoir 6. The coating solution reservoir 6 has a ceiling surface 6*a* inclined so as to be progressively lower from the end connected to the supply port 7 toward the opposite end which is closed. The inclined ceiling surface 6*a* allows air bubbles contained in the introduced coating solution to move along the inclined ceiling surface 6*a* toward the supply port 7.

Figure 4:
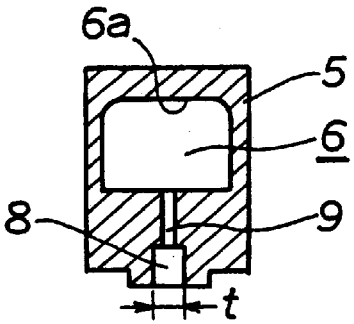
FIG. 4 is a cross-sectional view taken along line IV—IV of FIG. 3.

The elongate nozzle body 5 has an elongate coating solution holder 8 defined longitudinally in a lower portion thereof and opening downwardly away from the coating solution reservoir 6. The coating solution holder 8, which is of a rectangular cross section, is held in communication with the coating solution reservoir 6 through a number of equally spaced vertical narrow passages 9 defined in a bottom wall of the elongate nozzle body 5 and arrayed in the longitudinal direction of the elongate nozzle body 5. The coating solution holder 8 has a width "t" (see FIG. 4) selected to prevent the coating solution from falling off as droplets through the action of the surface tension of the coating solution itself. Inasmuch as the coating solution is prevented from falling off as droplets from the coating solution holder 8, the coating solution can be applied uniformly to the upper surface of the glass substrate W without causing coating irregularities thereon.

Each of the vertical narrow passages 9 has a diameter of not greater than 2 mm to prevent air bubbles from being trapped therethrough into the coating solution in the coating solution reservoir 6. However, the diameter of each of the vertical narrow passages 9 should be greater than 1.5 mm because the coating solution would not smoothly flow through the vertical narrow passages 9 if the diameter thereof were 1.5 mm or less. Any adjacent ones of the vertical narrow passages 9 should be spaced from each other by about 5 mm for supplying the coating solution therethrough uniformly to the coating solution holder 8.

If the ceiling surface 6*a* of the coating solution reservoir 6 were not inclined, the pressure of the coating solution would be higher at the closed end of the coating solution reservoir 6 remote from the supply port 7. However, since the ceiling surface 6*a* is inclined as shown and described above, the closed end of the coating solution reservoir 6 is narrower than the opposite end thereof which is connected to the supply port 7, making up for the pressure gradient which would otherwise be present. Accordingly, the coating solution in the coating solution reservoir 6 can be discharged through the vertical narrow passages 9 under a constant pressure along the coating solution reservoir 6.

Figure 5:
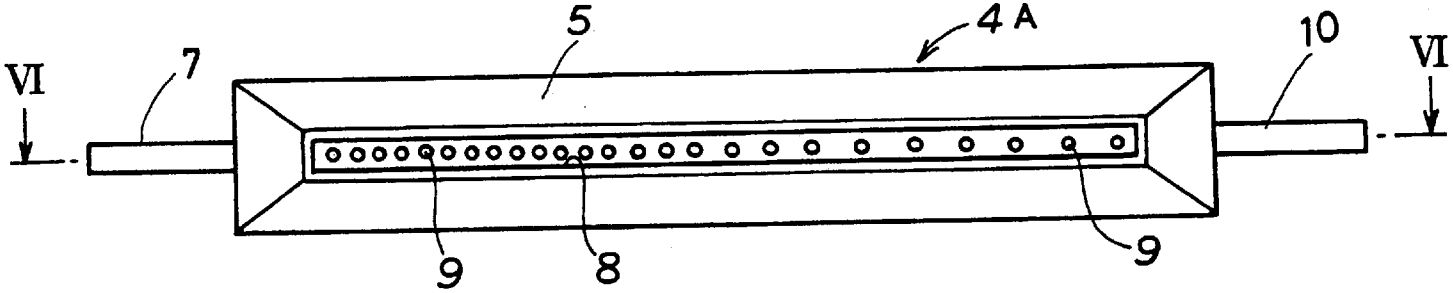
FIG. 5 is a bottom view of a coating nozzle according to another embodiment of the present invention.
Figure 6:
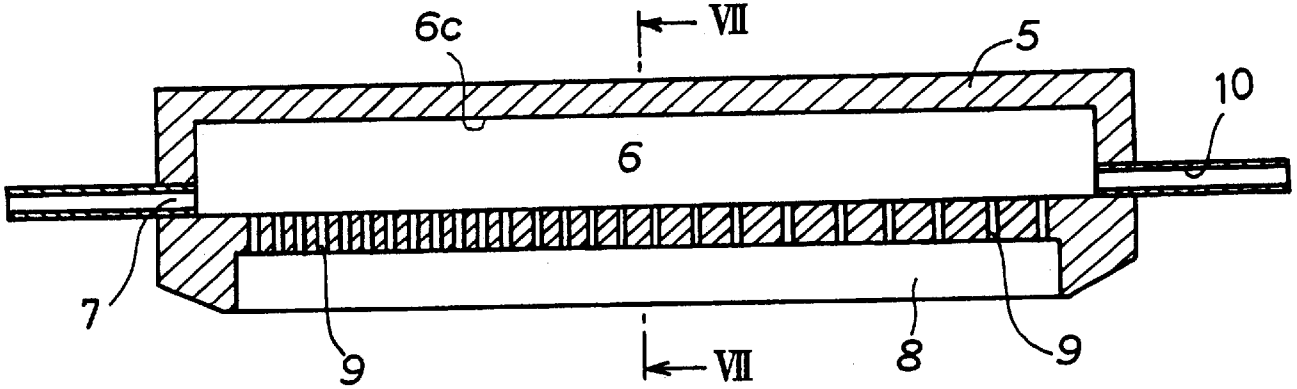
FIG. 6 is a cross-sectional view taken along line VI—VI of FIG. 5.
Figure 7:
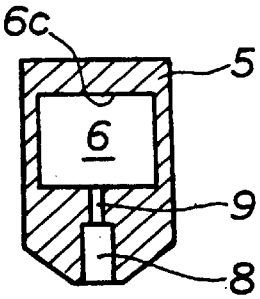
FIG. 7 is a cross-sectional view taken along line VII—VII of FIG. 6.

FIGS. 5 through 7 show a coating nozzle 4A according to another embodiment of the present invention. As shown in FIGS. 5 through 7, the coating nozzle 4A has an elongate nozzle body 5 with a coating solution reservoir 6 defined in and extending longitudinally of the elongate nozzle body 5. The nozzle body 5 has a supply port 7 disposed on one end thereof and connected to an end of the coating solution reservoir 6, for introducing a coating solution from an external coating solution supply through the supply port 7 into the coating solution reservoir 6, and a discharge port 10 disposed on the opposite end and connected to the opposite end of the coating solution reservoir 6 for discharging the coating solution from the coating solution reservoir 6. The coating solution reservoir 6 has a flat ceiling surface 6*c* extending parallel to a bottom wall thereof.

The elongate nozzle body 5 has an elongate coating solution holder 8 defined longitudinally in a lower portion thereof and opening downwardly away from the coating solution reservoir 6. The coating solution holder 8, which is of a rectangular cross section, is held in communication with the coating solution reservoir 6 through a number of vertical narrow passages 9 defined in the bottom wall of the elongate nozzle body 5 and arrayed in the longitudinal direction of the elongate nozzle body 5. The vertical narrow passages 9 are spaced by distances which are progressively greater in a direction from the supply port 7 toward the discharge port 10.

Since the ceiling surface 6*c* of the coating solution reservoir 6 is flat and the discharge port 10 is connected to the end of the coating solution reservoir 6 remote from the supply port 7, the pressure of the coating solution in the coating solution reservoir 6 would be lower at the end of the coating solution reservoir 6 connected to the discharge port 10. However, the pressure gradient is prevented from occurring because the vertical narrow passages 9 are spaced by distances which are progressively greater in the direction from the supply port 7 toward the discharge port 10, and hence the coating solution can be discharged through the vertical narrow passages 9 under a uniform pressure along the coating solution reservoir 6.

Alternatively, the vertical narrow passages 9 may be equally spaced along the coating solution reservoir 6, and the diameters of the vertical narrow passages 9 may be made progressively smaller in the direction from the supply port 7 toward the discharge port 10.

To prevent air bubbles from being introduced into the coating solution reservoir 6, the supply port 7 and the discharge port 10 should be of about the same cross-sectional area, and the coating solution should be introduced into the coating solution reservoir 6 through the supply port 7 while the coating solution holder 8 is closed. When the coating solution is introduced into the coating solution reservoir 6 through the supply port 7, any air present in the coating solution reservoir 6 is removed through the discharge port 10.

Figure 8:
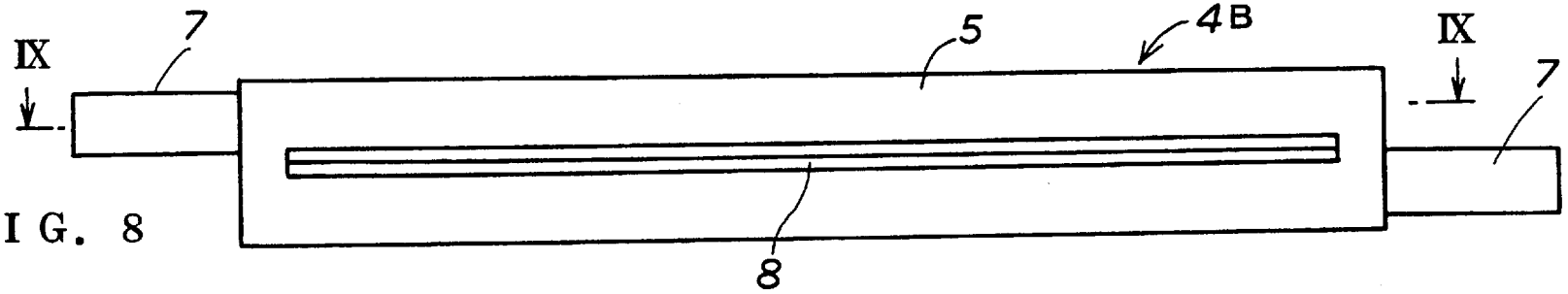
FIG. 8 is a bottom view of a coating nozzle according to still another embodiment of the present invention.
Figure 9:
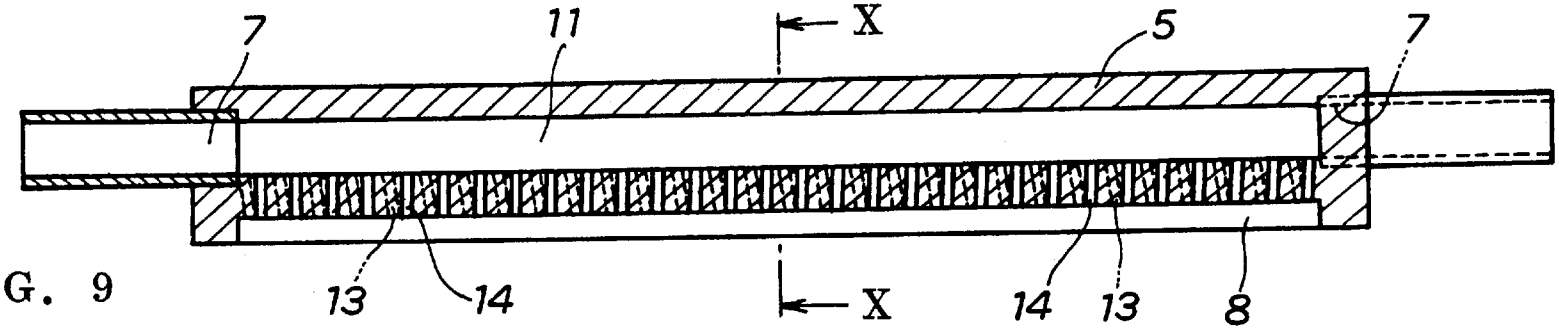
FIG. 9 is a cross-sectional view taken along line IX—IX of FIG. 8.
Figure 10:
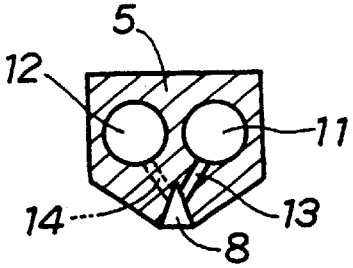
FIG. 10 is a cross-sectional view taken along line X—X of FIG. 9.

FIGS. 8 through 10 show a coating nozzle 4B according to still another embodiment of the present invention. As shown in FIGS. 8 through 10, the coating nozzle 4B has an elongate nozzle body 5 with a pair of parallel independent coating solution reservoirs 11, 12 defined in and extending longitudinally of the elongate nozzle body 5. The nozzle body 5 has a pair of supply ports 7 disposed on respective opposite ends thereof and connected to respective opposite ends of the coating solution reservoirs 11, 12, for introducing a coating solution from an external coating solution supply through the supply ports 7 into the coating solution reservoirs 11, 12.

The elongate nozzle body 5 has an elongate coating solution holder 8 defined longitudinally in a lower portion thereof and opening downwardly away from the coating solution reservoirs 11, 12. The coating solution holder 8, which is of a triangular cross section, is held in communication with the coating solution reservoir 11 through a number of equally spaced vertical narrow passages 13 defined in a bottom wall of the elongate nozzle body 5 and arrayed in the longitudinal direction of the elongate nozzle body 5. The coating solution holder 8 is also held in communication with the coating solution reservoir 12 through a number of equally spaced vertical narrow passages 14 defined in the bottom wall of the elongate nozzle body 5 and arrayed in the longitudinal direction of the elongate nozzle body 5. The vertical narrow passages 13 and the vertical narrow passages 14 are staggered relatively to each other in the longitudinal direction of the elongate nozzle body 5.

The coating solution is supplied in opposite directions through the supply ports 7 into the coating solution reservoirs 11, 12, and coating solution flows discharged from the coating solution reservoirs 11, 12 through the vertical narrow passages 13, 14 are combined in the coating solution holder 8. Therefore, the pressure of the coating solution in the coating solution holder 8 is made uniform, and hence the amount of the coating solution supplied to the coating solution holder 8 is also made uniform without suffering undue local variations. As a result, the coating solution in the coating solution holder 8 is prevented from falling off as droplets.

In the above embodiments, the coating solution holder 8 is not limited to the rectangular and triangular cross-sectional shapes, but may be of any cross-sectional shapes insofar as they can hold the coating solution supplied thereto. For effectively preventing the coating solution in the coating solution holder 8 from falling off as droplets, the coating solution holder 8 should preferably have a height of 10 mm or less, and the width "t" at the lower end of the coating solution holder 8 should preferably be of 4 mm or less.

Since the amount of the coating solution to be applied to the glass substrate W (see FIG. 1) is metered by the coating solution reservoir 6 or the coating solution reservoirs 11, 12 before the glass substrate W is rotated, the amount of the coating solution which is consumed can be minimized.

The coating device shown in FIG. 1, which incorporates the coating nozzle 4, 4A, or 4B, can supply a coating solution under a discharge pressure ranging from 0.1 to 0.5 $kg/cm^2$. Because the discharge pressure is relatively low, the amount of the coating solution which is consumed by the coating device is, again, minimized.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A method of coating a substrate with a coating solution with a coating nozzle including an elongate nozzle body having a coating solution reservoir defined longitudinally therein for being supplied with a coating solution from an external coating solution supply, a coating solution holder defined in the elongate nozzle body and opening away from the coating solution reservoir, for holding the coating solution against falling off as droplets under surface tension of the coating solution, and a plurality of passages defined in the elongate nozzle body and held in communication with the coating solution reservoir and the coating solution holder, for supplying the coating solution from the coating solution reservoir to the coating solution holder, said method comprising the steps of:

applying the coating solution supplied from said coating solution reservoir through said passages and said coating solution holder, to a substantially entire surface of the substrate; and thereafter rotating the substrate to spread the applied coating solution uniformly over the surface of the substrate under centrifugal forces.

2. A method of coating a substrate according to claim 1, wherein said elongate nozzle body has a pair of said coating solution reservoirs defined longitudinally therein for being supplied with the coating solution from said external coating solution supply, said reservoirs extend parallel to and are independent of each other, said coating solution holder opens away from the coating solution reservoirs, for holding the coating solution against falling off as droplets under surface tension of the coating solution, and has a pair of sets of said passages defined in the elongate nozzle body and held in communication with the coating solution reservoirs, respectively, and the coating solution holder, for supplying the coating solution from the coating solution reservoirs to the coating solution holder; and said applying step involves applying the coating solution supplied from said coating solution reservoirs through said passages and said coating solution holder, to the substantially entire surface of the substrate.

3. A method according to claim 1, wherein said applying step involves supplying the coating solution from said coating solution reservoir through said passages to said coating solution holder in a uniform amount along a full length of said holder.

4. A method of coating a substrate according to claim 1, wherein said elongate nozzle body has a supply port disposed in one end thereof and connected to an end of said coating solution reservoir, and a discharge port disposed in an opposite end thereof and connected to an opposite end of said coating solution reservoir, and said applying step involves introducing the coating solution through the supply port into the coating solution reservoir, discharging a portion of the coating solution from the coating solution reservoir through said discharge port, and discharging another portion of said coating solution from said holder.

5. A method of coating a substrate according to claim 1, wherein said applying step involves supplying said coating solution from said reservoir to said holder through said passages under a substantially uniform pressure along the coating solution reservoir.

6. A method of coating a substrate according to claim 1, wherein said applying step involves supplying coating solution from said coating solution reservoir through said passages and said coating solution holder to said substantially entire surface of the substrate while preventing droplets of the coating solution from falling off the coating nozzle onto the substrate.

7. A method of coating a substrate according to claim 1, wherein said coating solution reservoir and said passages are shaped and oriented such that said solution is supplied from the reservoir to the holder through the passages under a substantially constant pressure fully along along the holder during said applying step.

8. A method according to claim 7, wherein said elongate nozzle body has a supply port disposed in one end thereof and connected to an end of said coating solution reservoir.

9. A method of coating a substrate with a coating solution with a coating nozzle including an elongate nozzle body having a coating solution reservoir defined longitudinally therein for being supplied with a coating solution from an external coating solution supply, a coating solution holder defined in the elongate nozzle body and opening away from the coating solution reservoir, for holding the coating solution against falling off as droplets under surface tension of the coating solution, and a plurality of passages defined in the elongate nozzle body and held in communication with coating solution reservoir and the coating solution holder, for supplying the coating solution from the coating solution reservoir to the coating solution holder, said method comprising the step of:

applying the coating solution supplied from said coating solution reservoir through said passages and said coating solution holder to a substantially entire surface of the substrate.

10. A method of coating a substrate according to claim 9, wherein said elongate nozzle body has a pair of said coating solution reservoirs defined longitudinally therein for being supplied with the said coating solution from said external coating solution supply, said reservoirs extend parallel to and are independent of each other, coating solution holder opens away from the coating solution reservoirs, for holding the coating solution against falling off as droplets under the surface tension of the coating solution, and has a pair of sets of said passages defined in the elongate nozzle body and held in communication with the coating solution reservoir, respectively, and the coating solution holder, for supplying the coating solution from a coating solution reservoirs to the coating solution holder; and said applying step involves applying the coating solution from said coating solution reservoirs through said passages and said coating solution holder, to the substantially entire surface of the substrate.

11. A method according to claim 9, wherein said elongate nozzle body has a supply port disposed in one end thereof and connected to an end of said coating solution reservoir, and said reservoir and said passages are shaped such that said solution is supplied from the reservoir to the holder through the passages under a substantially constant pressure fully along the holder during said applying step.

12. A method of coating a substrate according to claim 9, wherein said elongate nozzle body has a supply port disposed in one end thereof and connected to an end of said coating solution reservoir, and a discharge port disposed in an opposite end thereof and connected to an opposite end of coating solution reservoir, and said applying step involves introducing the coating solution through the supply port into the coating solution reservoir, discharging a portion of the coating solution from the coating solution reservoir through said discharge port, and discharging another portion of said coating solution from said holder.

13. A method of coating a substrate according to claim 9, wherein said applying step involves supplying said coating solution from said reservoir to said holder through said passages under a substantially uniform pressure along the coating solution reservoir.

14. A method according to claim 13, wherein said applying step involves supplying the coating solution from said coating solution reservoir through said passages to said coating solution holder in a uniform amount along a full length of said holder.

15. A method of coating a substrate according to claim 14, wherein said coating solution reservoir and said passages are shaped and oriented such that said solution is supplied from the reservoir through the holder through the passages under a substantially constant pressure along the holder during said applying step such that the coating solution is supplied in said uniform amount along the full length of said holder.

16. A method of coating a substrate according to claim 9, wherein said applying step involves supplying the coating solution from said coating solution reservoir through said passages and said coating solution holder to said substantially entire surface of the substrate while preventing droplets of the coating solution from falling off the coating nozzle onto the substrate.

* * * * *

UNITED STATES PATENT AND TRADEMARK OFFICE

CERTIFICATE OF CORRECTION

PATENT NO : 5,972,426

DATED : 26 October 1999

INVENTOR(S): J. Kutuzawa, H. Sago, F. Shimai, H. Miyamoto

It is certified that error appears in the above-identified patent and that said Letters Patent are hereby corrected as shown below:

On the cover page, in the "ABSTRACT", after the final period insert the following sentence --The arrangement of the reservoir, the solution holder and the passages in the elongate nozzle body assures that a uniform layer of a coating solution is deposited by the nozzle on a surface of a planar substrate.--.

Column 2, line numbered between 5 and 6, after "invention" insert --is--;
line numbered between 8 and 9, after "invention" insert --is--.

Column 8, line 37 (claim 7, line 5), change "along along" to --along--;
line 51 (claim 9, line 10), after "with" insert --the--;
line 63 (claim 10, line 4), change "said coating" to --coating--;
line 65 (claim 10, line 6), change "coating" to --said coating--.

Column 9, line 3 (claim 10, line 11), change "reservoir" to --reservoirs--;
line 5 (claim 10, line 13), change "from a" to --from the--;
line 11 (claim 11, line 1), change "9" to --13--;
line 16 (claim 11, line 6), change "under a" to --under said--;
line 23 (claim 12, line 6), before "coating" insert --said--.

Column 10, line 6 (claim 14, line 1), change "13" to --9--.

Signed and Sealed this

Third Day of April, 2001

*Attest:*

Nicholas P. Godici

NICHOLAS P. GODICI

*Attesting Officer*

*Acting Director of the United States Patent and Trademark Office*